United States Patent [19]

Mustikka

[11] 4,148,398

[45] Apr. 10, 1979

[54] ROLLER SCREEN

[75] Inventor: Lauri A. Mustikka, Tornio, Finland

[73] Assignee: Outokumpu Oy, Outokumpu, Finland

[21] Appl. No.: 843,290

[22] Filed: Oct. 18, 1977

[30] Foreign Application Priority Data

Oct. 19, 1976 [FI] Finland ..... 762982

[51] Int. Cl.[2] ..... B07C 5/12

[52] U.S. Cl. ..... 209/668; 209/673

[58] Field of Search ..... 209/106, 98, 668, 673

[56] References Cited

U.S. PATENT DOCUMENTS

| | | | |
|---|---|---|---|
| 3,367,494 | 2/1968 | Peterson | 209/106 |
| 3,519,129 | 7/1970 | Peterson | 209/106 |

*Primary Examiner*—Allen N. Knowles

[57] ABSTRACT

A roller screen, expecially for screening pellets to be sintered, having several rotable transverse rollers in succession at a distance from each other, and control means for adjusting distance between at least the last rollers greater than the distances between the other rollers.

4 Claims, 2 Drawing Figures

ROLLER SCREEN

BACKGROUND OF THE INVENTION

The present invention relates to a roller screen having several rotatable transverse rollers in succession at a distance from each other. The invention relates especially to a roller screen intended for the screening of pellets to be sintered, in which the overflow is intended to be fed to the sintering furnace and the underflow is returned to the pelleting process.

Many smelting processes require that the material to be smelted is not too finely divided, and therefore a finely divided raw material, e.g. a concentrate, must first be pelleted and thereafter sintered to increase the strength of the pellets. The capacity of a sintering furnace is, however, dependent, for example, on the size of the pellets fed into it. For this reason a roller screen is usually fitted between the pelleting plate and the sintering furnace. The roller screen separates the smallest pellets from the sintering furnace feed and returns them to pelleting in order to increase their particle size and to increase the sintering furnace capacity. However, the capacity of the sintering furnace varies, so that it is not always capable of receiving all the overflow from the roller screen.

The object of the present invention is to provide a roller screen of an improved type, by means of which the overflow quantity can be regulated.

SUMMARY OF THE INVENTION

In a roller screen according to the invention, the distance of at least the last rollers from each other is adjusted during operation to be greater than the distances between the other rollers in order to regulate the overflow quantity in accordance with the following treatment stages and selectively so that substantially all of the pellets in the overflow are larger than the pellets separated from it and returned to pelleting.

In a preferred embodiment of the invention, the rollers can also be adjusted so that the distance between the rollers increases in the travel direction of the material being screened.

It is evident that a roller screen according to the invention, in which the distance between the rollers can be adjusted, can be used for screening even other granular materials than pellets to be sintered, here suggested as an example. Using a roller screen according to the invention, different fractions can be obtained by returning the overflow to the roller screen, and by increasing the distance between the rollers before each return and after the removal of the classified overflow.

DESCRIPTION OF THE PREFERRED EMBODIMENTS

Figure 1:
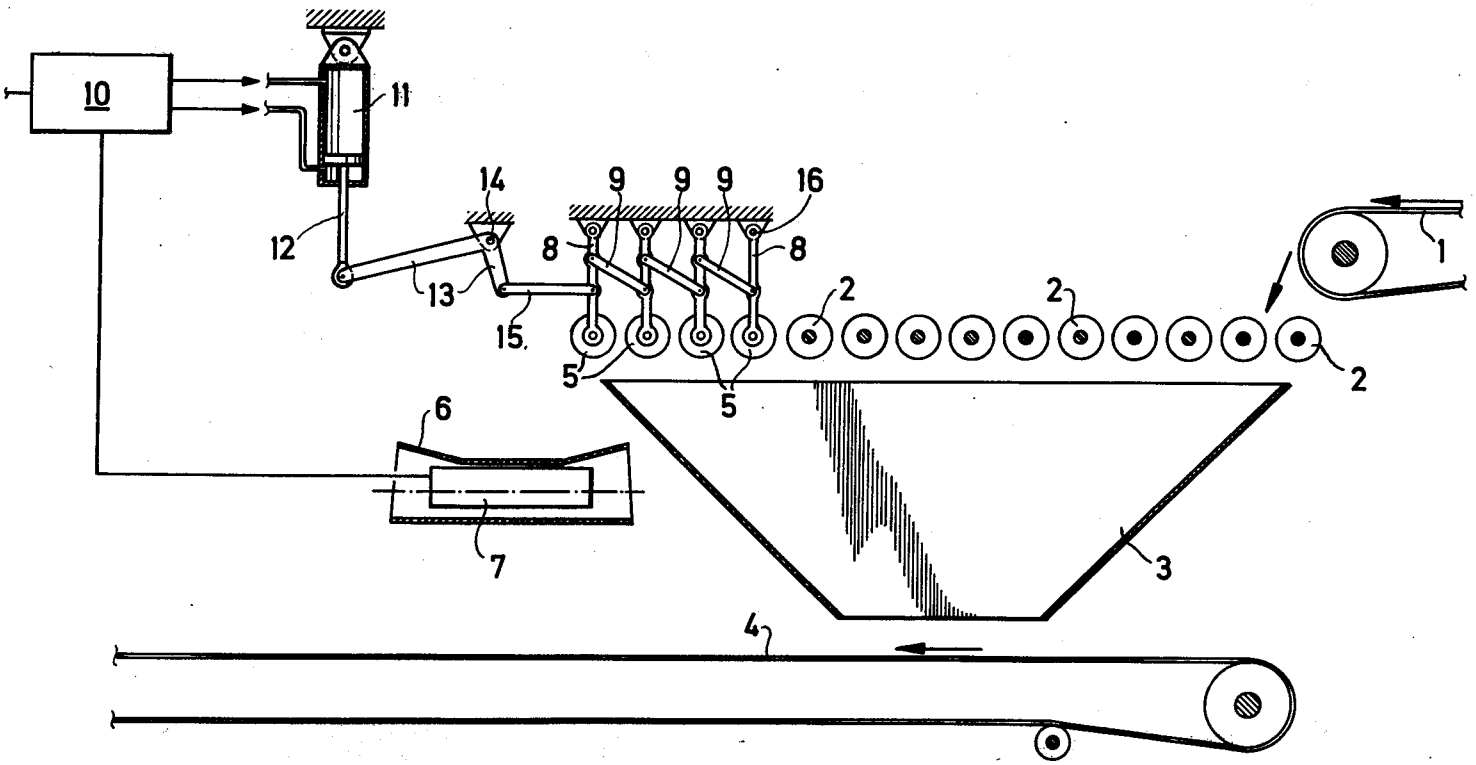
FIG. 1 depicts a schematic side elevation of a preferred embodiment of the invention.

In FIG. 1, reference numeral 1 indicates a belt conveyor, on which the pellets arrive from the pellet plate and which deposits the pellets onto the roller screen. Numeral 2 incicates the fixed rollers of the roller screen; there are 10 of them before the regulatable section. The distance between the fixed rollers is 5 mm, and through the clearances between these rollers pellets and concentrate <5 mm pass into a collecting hopper 3 under the roller screen and further onto a belt conveyor 4, which returns them to the pellet plate feed conveyor. Pellets >5 mm pass over the fixed rollers 2 of the roller screen and continue over the rollers 5 of the regulatable section onto a belt conveyor 6, which conveys them further to the sintering furnace feed conveyor and into the furnace. The minimum distances between the rollers 5 in the regulatable section of the roller screen are the same as those in the fixed section, i.e. 5 mm. This minimum distance can be increased by shortening the intermediate arms 15 on both sides of the roller screen. At this time the piston and piston arm 12 of the actuating cylinder 11 must be in the lower position.

The distances between the rollers in the regulatable section can also be adjusted by, for example, adjusting the intermediate arms 9 to different lengths. The attachment points of the intermediate arms 9 to the supporters 8 determine how the roller intervals increase at the time of adjustment.

The travel distances of the rollers 5 in relation to each other can be determined by the position of the bearing centers at the suspension points 16 of supporters 8 and the bearings 18 of the ends of the intermediate arms 9.

The maximum displacement of the rollers 5 in the regulatable section depends on the distance between the piston arm 12 and the attachment point 14. This distance can be changed by changing the attachement point of the piston arm. The stroke of the piston and the piston arm is constant. Belt scales 7 weigh the pellet quantity travelling on the conveyor. The belt scales give an impulse to a control device 10, which operates by either manual or automatic control.

If the desired pellet feed into the furnace is, for example, 15 t/h and the control range of the scales is 0–30 t/h, the scales are set at 50%. Now, if the pellet quantity passing over the scales 7 corresponds to a feed of 20 t/h, the scales give a "message" to the control device 10. The deviation indicator in the control device shows this feed of 20 t/h, and since the set set value is 15 t/h, the control device 10 adjusts the actuating cylinder 11 to reduce the pellet quantity feed from the roller screen.

At this time the piston 12 rises and turns the lever arm 13 about the bearing point 14, and the intermediate arms 15 increase the distances between the rollers.

Thereby the smallest pellets passing over the rollers pass between the rollers into the hopper 3 and are returned to the pellet plate. Thus the pellet quantity conveyed into the furnace on the belt conveyor 6 is reduced. If the pellet quantity passing over the scales 7 is smaller than the set value, the distance between the rollers is respectively reduced, and the pellet quantity increases. A prerequisite of the operation is that the pellet size remains such that some pellets are recycled from the regulatable section.

Thus, in order that the regulatable section function, the pellet quantity arriving on the adjustable section must be at least as great as the pellet quantity passing into the furnace.

If all the rollers of a roller screen are made adjustable, the current, inconvenient roller screens with fixed rollers are eliminated and adjustable roller screens are obtained.

Figure 2:
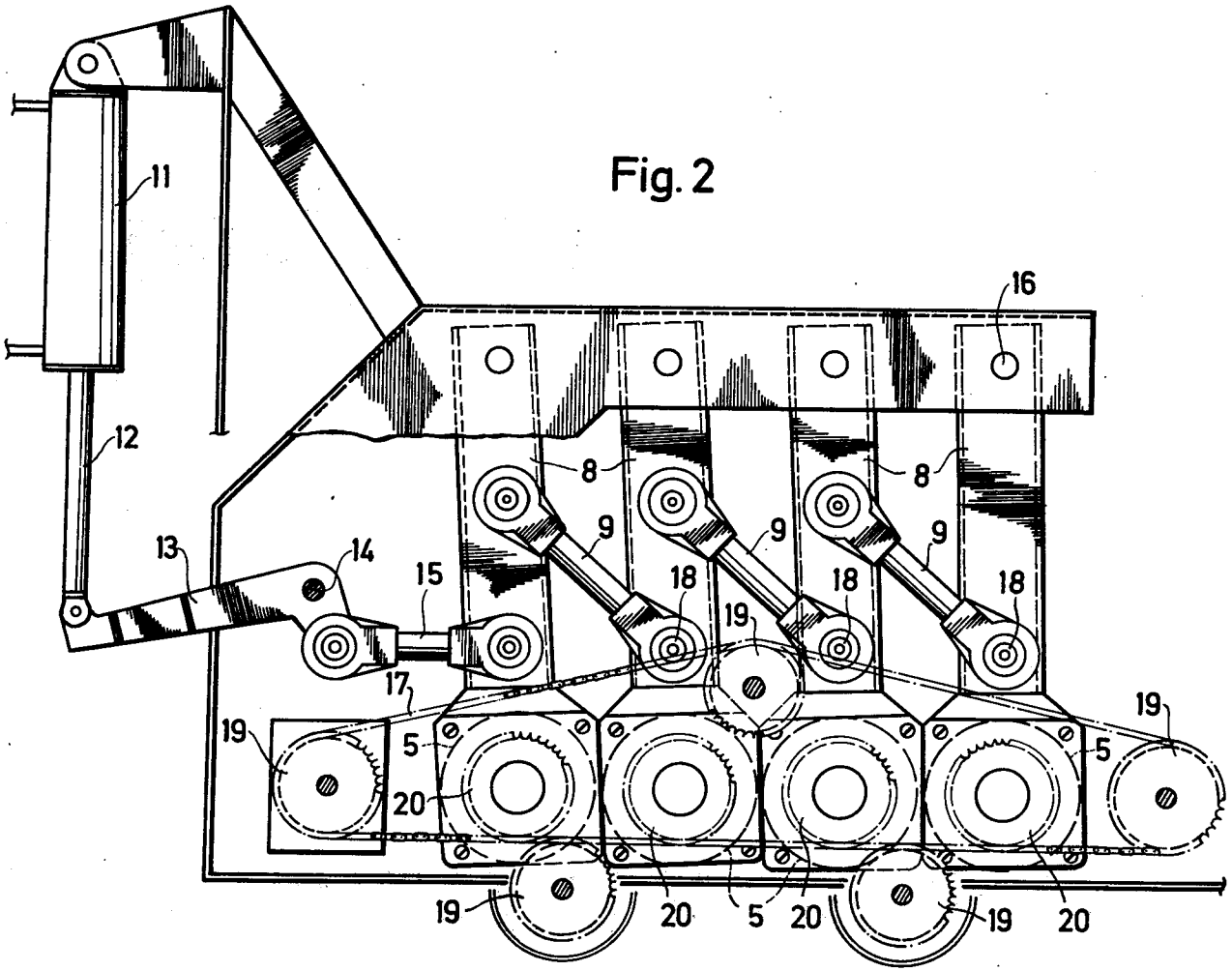
FIG. 2 depicts a more detailed side elevation of the regulatable section of the roller screen shown in FIG. 1.

As can be seen in more detail in FIG. 2, the adjustable rollers 5 have been suspended from supporters 8 attached with bearings at their upper ends. The supporters 8 have been connected to each other by means of intermediate arms 9 so that, when a roller 5, and thus also the lower end of a supporter 8, moves over some distance in the longitudinal direction of the roller screen, the preceding roller moves over only half of this distance. By means of the attachments 18 of the intermediate arms 9 to the supporters 8, the distances between the rollers can, furthermore, be adjusted to the selected size. In the embodiment described, the distances between the rollers increase towards the discharge end of the roller screen.

The last supporter 8 has been connected to the piston arm 12 of the actuating cylinder 11 via an intermediate arm 15 and a lever arm 13.

The rollers 5 are driven with the aid of an endless chain 17, which is controlled by means of chain wheels so that the sprockets 20 at the ends of the shafts of the rollers 5 are in functional contact with the driving side of the chain 17 but can be moved reciprocally to adjust the distance between the rollers. Between the driving lower side of the chain 17 there is preferably a guide rail (not shown in the figure), which ensures that the chain is in contact with the sprockets 20.

The following advantages are gained by using a roller screen according to the invention:

Small pellets are recirculated and large ones pass into the furnace, whereby the pelleting will be more even.

The distribution and penetration of the furnace gases is improved when the granule size of the pellets fed into the furnace becomes more even and larger; a mixture of small and large pellets clogs the furnace. The screen grades with greater efficiency.

The strength of the sintered pellets is improved, as is their dry compression strength, i.e. the breakage of the pellets in the furnace is reduced and less dust is produced. The reliability of operation is thereby improved.

The capacity and screening efficiency of the roller screen are improved. Using the currently used feed of approx. 20 t/h, a roller screen with a fixed construction does not have the time to screen the pellets, but concentrate and small pellets (nuclei) also pass into the furnace.

The adjustment of the roller screen clearances is simple. Before, the roller size had to be changed when the distance between the rollers was to be changed:

there had to be rollers of several sizes, and consequently the storage, manufacturing and installation costs were high the changing of the distances between the rollers required a stoppage when the pellet size became smaller than the distance between the rollers, no pellets were obtained in the furnace (at the beginning of operation)

when it was desired to change the pellet size, the change was difficult the underflow quantity was heretofore great As the underflow quantity is reduced, the grinding cost and other costs for treating the underflow are reduced.

What is claimed is:

1. A roller screen of the type having a frame and a plurality of rollers rotatably mounted spacedly transversely on said frame in succession, said screen comprising means attached to the frame and at least one of the last of the series of rollers downstream for controlling the distance between at least one of said rollers and at least one other of said rollers, said controlling means comprising pivoting arms affixed at opposite ends of said adjustable rollers with one end attached to one end of the adjustable roller and the other end attached to said frame, intermediate arms pivotably attached between said pivoting arms of adjacent rollers; and means mounted in the frame and operatively connected with said pivoting arms for controlling the distance between the adjustable rollers.

2. The roller screen of claim 1, in which one end of an intermediate arm is pivoted to the pivoting arm of the next adjustable roller at a point which is closer to its pivot point so that each pivoting arm turns more than the preceding pivoting arm when actuated.

3. The roller screen of claim 1, in which the actuating means is connected to the pivoting arm of the last adjustable roller by means of an intermediate arm.

4. The roller screen of claim 1, in which the actuating means is controlled by a control device, which has been connected to scales following the roller screen, in order to adjust the distance between the rollers responsive to the overflow quantity.

* * * * *